US005083600A

United States Patent [19]

Weishar et al.

[11] Patent Number: 5,083,600

[45] Date of Patent: Jan. 28, 1992

[54] DRIVE MECHANISM FOR AN INDUSTRIAL DOOR

[75] Inventors: William B. Weishar, Brookfield; Joe M. Delgado, Waukesha, both of Wis.

[73] Assignee: Kelley Company Inc., Milwaukee, Wis.

[21] Appl. No.: 505,227

[22] Filed: Apr. 5, 1990

[51] Int. Cl.[5] ..... E06B 9/70

[52] U.S. Cl. ..... 160/310; 160/133; 160/311; 192/0.02 R

[58] Field of Search ..... 160/1, 2, 7, 310, 311, 160/133; 248/632, 634, 635, 605, 550; 192/0.02 R, 0.048

[56] References Cited

U.S. PATENT DOCUMENTS

| | | | |
|---|---|---|---|
| 1,441,229 | 1/1923 | Lacey | 160/310 |
| 2,549,768 | 4/1951 | Bradley | 248/632 X |
| 3,460,602 | 8/1969 | Hugus . | |
| 3,878,879 | 1/1975 | Mann | 160/273 |
| 3,981,343 | 9/1976 | DeVito | 160/9 |
| 4,045,123 | 8/1977 | Brown | 160/310 X |
| 4,142,701 | 3/1979 | Fujii et al. | 248/632 X |
| 4,628,556 | 12/1986 | Blackman | 248/550 X |
| 4,770,224 | 9/1988 | Dubbelman | 160/331 |
| 4,844,140 | 7/1989 | Jones et al. | 160/310 |
| 4,850,418 | 7/1989 | Bresson | 160/310 |

FOREIGN PATENT DOCUMENTS

| | | | |
|---|---|---|---|
| 145221 | 2/1952 | Australia | 248/605 |
| 2556403 | 6/1985 | France . | |

*Primary Examiner*—Carl D. Friedman
*Assistant Examiner*—Derek J. Berger
*Attorney, Agent, or Firm*—Andrus, Sceales, Starke & Sawall

[57] ABSTRACT

A drive mechanism for an industrial door. A rotatable drive member is operably connected to the door and rotation of the drive member in one direction through operation of a motor will move the door to the closed position while rotation of the member in the opposite direction will move the door to the open position. A clutch mechanism interconnects the motor and the drive member and is movable between an engaged and disengaged position. The clutch mechanism is biased to the engaged position, and by manually pivoting an actuating member that is connected to the clutch mechanism, the clutch mechanism can be moved to the disengaged position, and is retained in the disengaged position until manually released. A switch is operably connected to the motor, and when the actuating member is pivoted to a position to disengage the clutch, the switch will be actuated to shut off power to the motor.

10 Claims, 2 Drawing Sheets

FIG. 2
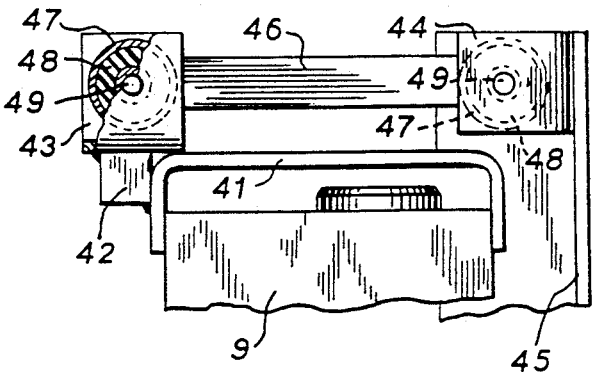
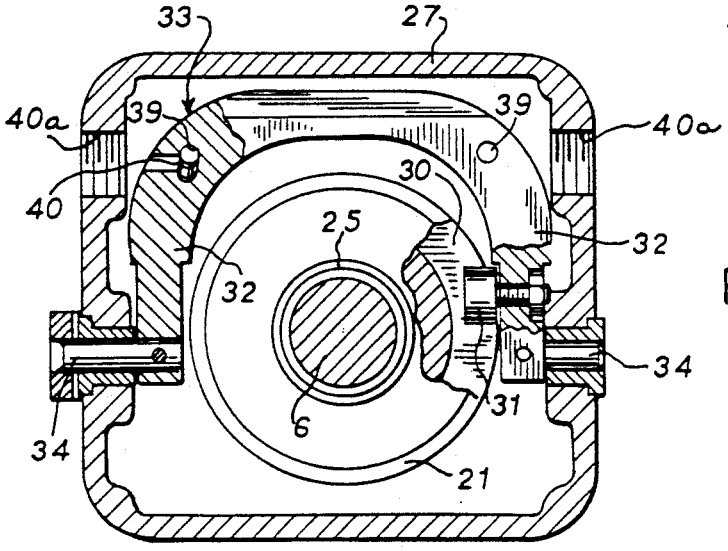
FIG. 4
FIG. 5
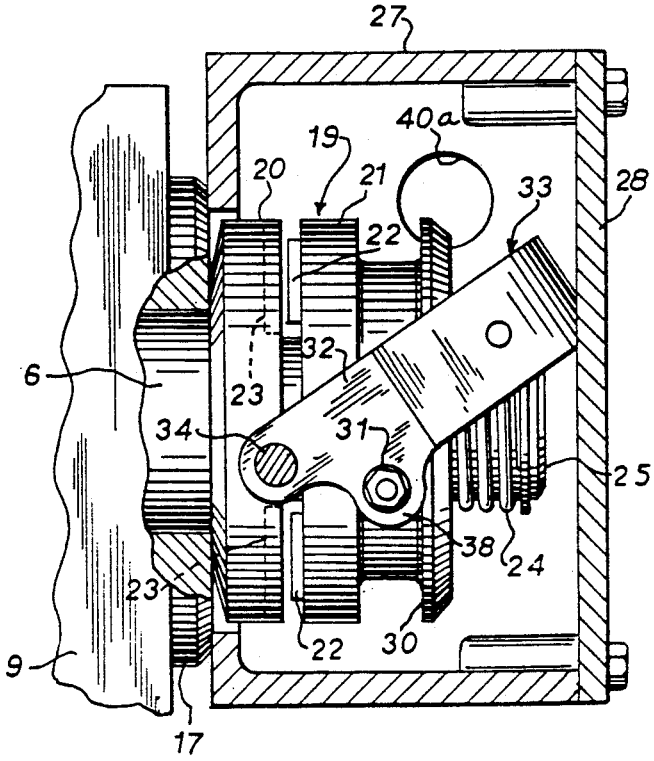

DRIVE MECHANISM FOR AN INDUSTRIAL DOOR

BACKGROUND OF THE INVENTION

Industrial doors in industrial or commercial buildings separate zones of different temperature or humidity conditions or prevent noise propagation between the zones. One common form of industrial door is a roll door in which a fabric door panel is coiled on a drum located above the header of the doorway. A drive mechanism is connected to the drum, and operation of the drive mechanism in one direction will uncoil the door panel to move the panel to a closed position, while operation of the drive mechanism in the opposite direction will act to coil the panel on the drum and move the door panel to the open position.

A typical drive mechanism for an industrial door includes a clutch which can be manually operated to disconnect the drive. A clutch is required in order to provide manual operation of the door in case of fire or a power outage or during maintenance or installation of the door.

With a conventional clutch as used with an industrial door, the motor will continue to operate when the clutch is disengaged. If an attempt is made to engage the clutch while the motor is operating, jamming or shearing of the components of the drive system can frequently occur. Therefore, there has been a need for a drive mechanism for an industrial door in which disengagement of the drive system will also act to shut off power to the drive source or motor.

SUMMARY OF THE INVENTION

The invention is directed to an improved drive mechanism for an industrial door. The drive mechanism includes a rotatable drive member which is operably connected to the door, and in the case of a roll door, the rotatable drive member is a shaft that is connected to the drum on which the fabric door panel is wound and unwound. A clutch is innerconnected between the rotatable member and the power source or motor, and the clutch is biased to an engaged position in which rotation of the motor is transmitted to the rotatable member to operate the door.

A manually pivotable actuating member or lever is operably connected to the clutch, and through pivoting movement of the lever, the follower on the lever will engage and move one of the clutch members out of engagement with the other clutch member, thus moving the clutch to the disengaged position. When the lever is fully pivoted the follower will be in an over-center position with respect to a horizontal plane extending through the pivot axis of the lever so that the biasing mechanism will then retain the lever in the pivoted position and the clutch in the disengaged position. To return the clutch to the engaged position, the lever is manually pivoted back to its original position.

The invention also includes a switch which is incorporated with the lever and is connected in electrical circuit with the motor. When the lever is pivoted to the over-center position to disengage the clutch, the switch will be actuated to shut off power to the motor. Conversely, when the lever is pivoted back to its original position, the switch will reestablish power to the motor.

The invention provides a simple construction which combines the clutching function with an electrical disconnect in the same hardware. By disconnecting the power when the clutch is disengaged, engagement of the clutch is prevented while the motor is operating, thus eliminating the possibility of jamming and shearing of the drive components.

As a feature of the invention, the drive member is driven directly from the motor and one end of the drive member is connected to the drum of the roll door, while the opposite end of the drive member is connected to the clutch. This construction eliminates the normal coupling that is employed to connect the drum shaft with the driving shaft, and thus eliminates the need for precise alignment of the shafts. In the conventional construction, the coupling compensates for misalignment between the drum shaft and the driving shaft. However, any misalignment can exert an undue load on the shaft bearings.

Other objects and advantages will appear in the course of the following description.

DESCRIPTION OF THE DRAWINGS

The drawings illustrate the best mode presentedly contemplated of carrying out the invention.

In the drawings;

FIG. 2 is a view taken along line 2—2 of FIG. 1;

FIG. 4 is a section taken along line 4—4 of FIG. 3 with parts broken away; and FIG. 5 is a view similar to FIG. 3 showing the clutch in the disengaged position.

DESCRIPTION OF THE ILLUSTRATED EMBODIMENT

Figure 1:
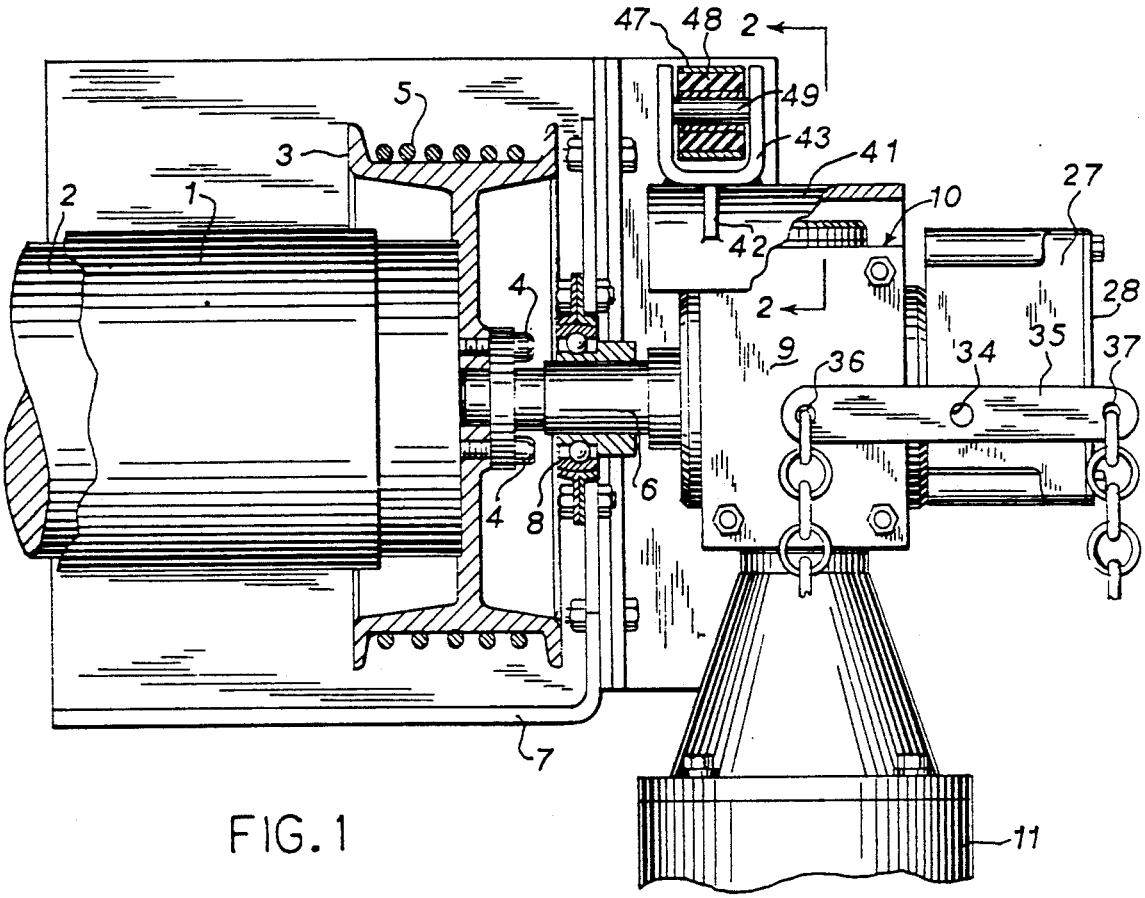
FIG. 1 is a fragmentary front elevation of the drive mechanism for the roll door with parts broken away.

The drawings illustrate an improved drive mechanism for an industrial door. As illustrated in the drawings, the door is a roll door in which flexible fabric material 1 is coiled on a drum 2 that is located above the header of a doorway in a building. As shown in FIG. 1, a spool 3 is attached to each end of drum 2 by a plurality of bolts 4, and a cable 5 is wound on each spool 3 and is operably connected to a counterbalancing system, not shown, which acts to partially counter balance the weight of the door panel and maintain the panel in a generally stretched condition when the door is closed.

Figure 3:
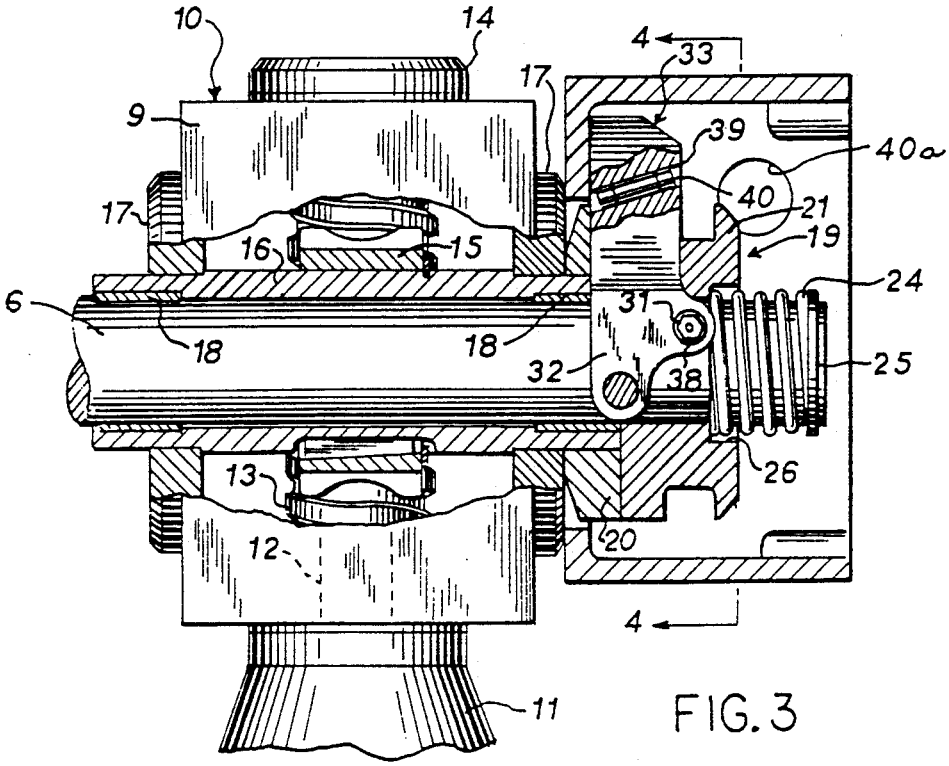
FIG. 3 is an enlarged front elevation, with parts broken away, showing the clutch in the engaged position; s

One end of a shaft or drive member 6 is connected to drum 2 and as shown in FIG. 1, shaft 6 is journalled within an opening in frame 7 by a bearing assembly 8. Shaft 6 extends through openings in the opposite end of a casing 9 of gear box 10. As best illustrated in FIG. 3, a motor 11 is suspended from gear box 10, and the vertical drive shaft 12 of motor 11 carries a worm gear 13. The upper end of drive shaft 12 is journalled within a bearing 14 mounted in the upper surface of casing 9.

Worm gear 13 is engaged with a worm wheel 15 which is secured to sleeve 16 that is mounted concentrically of shaft 6. Sleeve 16 is journalled through bearings 17 in opposite sides of the casing 9. Thus, rotation of drive shaft 12 is transmitted through the gear arrangement to sleeve 16. In addition, shaft 6 is journalled for rotation within sleeve 16 by a pair of bushings 18, as seen in FIG. 3.

A clutch 19 innerconnects the sleeve 16 with shaft 6. Clutch 19 includes a clutch element 20 which is located outwardly of casing 9, and is secured to sleeve 16. In addition, the clutch unit includes a second clutch element 21 which is keyed to shaft 6. The connection between clutch element 21 and shaft 6 will enable shaft 6 to rotate in accordance with clutch element 21, but permits the clutch element 21 to move axially relative to shaft 6.

Clutch element 21 is provided with a pair of radial lugs 22 which are adapted to engage radial grooves 23 in clutch element 20 when the clutch unit is in the engaged position. With the clutch engaged, rotation of sleeve 16 will be transmitted through the engaged clutch to shaft 6 to thereby drive drum 2.

The clutch 19 is biased to the engaged position by a coil spring 24. One end of spring 24 bears against a snap ring 25 which is secured to the outer end of shaft 6, while the inner end of spring 24 is engaged with the bottom of a recess 26 formed in clutch element 21. With this construction, the force of spring 24 will urge clutch element 21 axially toward clutch element 20 to provide an engaged relationship.

As best shown in FIG. 1, clutch 19 is enclosed within an outer housing 27 having an open end which can be removably enclosed by a cover 28.

Clutch 19 is adapted to be manually moved to the disengaged position to thereby disconnect the drum 2 from the drive system. In this regard, clutch element 21 is provided with a peripheral groove 30, and a pair of followers or rollers 31 ride in groove 30. The followers 31 are mounted for rotation on the generally parallel arms 32 of a U-shaped yoke 33, which is mounted within housing 27. As shown in FIG. 4, the ends of arms 32 are pivotally connected to housing 27 by pivot shafts 34 so that the yoke can be pivoted around the axes of shafts 34. As seen in FIG. 1, the central portion of a lever 35 is connected to one of the pivot shafts 34, and through movement of the lever 35, the yoke can be pivoted through an arc of about 60°. The ends of lever 35 are provided with holes 36 and 37, respectively, and chains or other operating members can be engaged with holes 36 and 37 so that the lever can be manually pivoted about the pivot axis of shaft 34.

With the clutch engaged, yoke 33 will be in the position as shown in FIG. 3 in which the axes of the followers 31 are located above a horizontal plane passing through the axis of the clutch 19. To disengage the clutch, the right hand end of lever 35, as shown in FIG. 1, is pulled downwardly, thus pivoting yoke 33 to the position shown in FIG. 5. In this pivoting action, the follower 31 will move through an arc about the pivot axis 34, and will thus move clutch element 21 axially out of engagement with clutch element 20 to disengage the drive.

During the pivotal movement of yoke 33, the axes of followers 31 will move beyond the horizontal plane passing through the axis of clutch 19 to an over-center position. In this over-center position, the force of spring 24 will prevent the yoke from pivoting back to its original position, and thus will maintain the clutch in the disengaged position. Engagement of the central portion of yoke 33 with the inner surface of cover 28 will limit or establish the position of the yoke in the over-center position, as seen in FIG. 5.

When it is desired to reengage the clutch 19, the lever 35 is pivoted manually to thereby pivot the yoke to its original position, and the force of spring 24 will then bias the clutch to the engaged position. As best shown in FIGS. 3 and 5, the arms 32 of yoke 33 are provided with protrusions 38, and the followers are mounted on the inner surface of the protrusions.

As a feature of the invention, power to motor 11 is automatically shut off when clutch 19 is disengaged. To provide this action, yoke 33 is provided with a pair of passages 39, and a mercury switch 40 is secured within one of the passages 39 by potting or the like. Switch 40 is connected in an electrical circuit with motor 11 and the electrical leads which connected the switch to the motor extend from the housing 27 through hole 40*a*.

A mercury switch 40 is only mounted in the passages 39, but the two passages provide either left or right mounting of the unit.

Switch 40 is located in an inclined position, as shown in FIG. 3, when clutch 19 is engaged. As yoke 33 is pivoted to the clutch-disengaged position, as seen in FIG. 5, switch 40 will move to a horizontal position and then to an opposite inclined position. This over-horizontal movement will de-energize switch 40 to shut off power to motor 11. Conversely, when yoke 33 is returned to its original position, as shown in FIG. 3, switch 40 is activated to re-establish power to the motor.

Shaft 6 directly connects drum 2 with clutch 19, and thus no resilient shaft coupling is required. To compensate for mechanical stresses, a resilient mounting is incorporated between frame 7 and the gear box 10. As illustrated in FIGS. 1 and 2, a channel 41 is secured to the upper end of gear box 10, and one end of the channel is connected through web 42 to the lower surface of a U-shaped bracket 43. A second U-shaped bracket 44 is secured to frame member 45, and a link 46 extends between the brackets 43 and 44.

To provide a resilient connection, each end of link 46 includes a circular collar 47 which is disposed around a ring 48 of resilient material, such as urethane, and each ring 48 in turn is mounted around a pin 49 that extends between the arms of the respective brackets 43, 44. With this construction, deformation of the resilient rings 48 will permit limited movement of gear box 10 and motor 11 relative to frame 7 to compensate for mechanical stresses.

The invention provides a simple construction in which the clutch and the power shut off are combined as a single unit. The construction will automatically stop operation of the motor when the drive is disengaged, thereby preventing the clutch from being reengaged while the motor is operating.

As shaft 6 directly connects the clutch with the drum, no shaft coupling is required as in conventional mechanisms, and the construction of the invention thus eliminates the need for precise shaft alignment.

Various modes of carrying out the invention are contemplated as being within the scope of the following claims particularly pointing out and distinctly claiming the subject matter which is regarded as the invention.

We claim:

1. An industrial door construction, comprising a door to enclose a doorway in a structure, a rotatable drive member operably connected to said door, rotation of said drive member in one direction acting to move said door to the open position and rotation of said drive member in the opposite direction acting to move the door to the closed position, reversible drive means, clutch means interconnecting said drive means and said drive member and movable between an engaged position and an disengaged position, biasing means for urging said clutch to the engaged position, an actuating member, pivoting means for mounting said actuating member for pivoting movement between a first position and a second position, operating means for pivoting said actuating member in a first direction between said first and second positions, engaging means mounted on said actuating member and engaged with said clutch means for moving said clutch means to said disengaged position as said actuating member is moved from said first position to the second position, and position responsive switch means carried by said actuating member which discontinues operation of the drive means when said actuating member pivots from said first position to said second position.

2. The construction of claim 1, wherein said pivot means comprises a pivot shaft and said engaging means comprises a roller engaged with said clutch means, said roller constructed and arranged so that operation of the operating means will move the roller from an under-center position on one side of the axis of said clutch means to an over-center position on the opposite side of the axis of said clutch means, said biasing means being constructed and arranged to maintain said roller in the over-center position to thereby maintain said clutch means in the disengaged position.

3. The construction of claim 2, wherein said clutch means includes a first clutch element and a second clutch element disposed for axial movement relative to said first clutch element, said second clutch element having a surface engaged by said roller, movement of said roller from said under-center position to said over-center position acting to move said second clutch member axially relative to said first clutch member to thereby disengage said clutch.

4. The construction of claim 3, wherein said actuating member is a yoke composed of a pair of generally parallel arms and a connecting web, said construction including a pair of said rollers each journalled on one of said arms, said pivot means being connected to said arms.

5. The construction of claim 2, wherein said position responsive switch means comprises a mercury switch, said switch being disposed at an angle to the horizontal when the roller is in both the under-center and over-center positions.

6. The mechanism of claim 1, and including resilient means innerconnecting said drive means and said structure.

7. The mechanism of claim 6, wherein said resilient means includes an elongated member having a ring at each end, a shaft disposed concentrically of each ring, one of said shafts being connected to said drive means and the other of said shafts being connected to said structure, and an annular resilient member disposed between each ring and the respective shaft.

8. The construction of claim 1, wherein said actuating member comprises a yoke and said position responsive switch means comprises a mercury switch.

9. The construction of claim 1, and including locking means for retaining said clutch means in said disengaged position.

10. The construction of claim 9, and including means for pivoting the actuating member in a second direction opposite to said first direction to release said locking means.

* * * * *

UNITED STATES PATENT AND TRADEMARK OFFICE

CERTIFICATE OF CORRECTION

PATENT NO. : 5,083,600

DATED : January 28, 1992

INVENTOR(S) : WILLIAM B. WEISHAR ET AL

It is certified that error appears in the above-identified patent and that said Letters Patent is hereby corrected as shown below:

Col. 4, Line 67, CLAIM 1, Delete "pivoting" and substitute therefor --pivot--; Col. 6, Line 15, CLAIM 7, After "elongated" insert --rigid--

Signed and Sealed this

Twenty-fifth Day of May, 1993

*Attest:*

Michael K. Kirk

MICHAEL K. KIRK

*Attesting Officer*

*Acting Commissioner of Patents and Trademarks*